United States Patent [19]

Foster

[11] 4,198,771

[45] Apr. 22, 1980

[54] CLIMBING AID

[75] Inventor: Lloyd B. Foster, Sturgeon Bay, Wis.

[73] Assignee: The Bootmakers of Sturgeon Bay, Inc., Sturgeon Bay, Wis.

[21] Appl. No.: 894,685

[22] Filed: Apr. 10, 1978

[51] Int. Cl.[2] ..... A43B 23/00; A43C 15/04; A43C 15/06

[52] U.S. Cl. ..... 36/136; 36/66; 182/221

[58] Field of Search ..... 36/136, 62, 66, 65, 36/1; 182/221, 134

[56] References Cited

U.S. PATENT DOCUMENTS

| | | | |
|---|---|---|---|
| 237,275 | 2/1881 | Hill . | |
| 303,955 | 8/1884 | Spencer . | |
| 537,492 | 4/1895 | Smith | 36/136 X |
| 664,832 | 1/1901 | Charles . | |
| 741,349 | 10/1903 | Link | 36/66 |
| 1,150,372 | 8/1915 | Jones | 182/221 |
| 1,942,325 | 1/1934 | Davidson | 36/1 X |
| 2,211,291 | 8/1940 | Rupp . | |
| 2,391,810 | 12/1945 | Webber | 182/221 |
| 2,401,891 | 6/1946 | Smith . | |
| 3,297,105 | 1/1967 | Lawrence | 182/221 X |
| 4,073,075 | 12/1978 | O'Brien | 36/136 X |

*Primary Examiner*—James Kee Chi

[57] ABSTRACT

A climbing aid comprising a rigid support bar having a climbing spike at one end and held in a horizontally disposed slot in a boot.

12 Claims, 4 Drawing Figures

CLIMBING AID

BACKGROUND

This invention relates to a climbing aid, e.g., to assist hunters to scale trees to reach suitable positions from which to hunt.

There is a common requirement, e.g., by hunters and forestry personnel, to be able to scale trees safely and easily and, because such persons are frequently required to travel on foot over difficult terrain, it is generally desirable that aids to such climbing be convenient to carry and use. Conventional strap-on climbing irons used, e.g., by telephone repair personnel, however, are uncomfortable to wear continuously and awkward to carry.

SUMMARY OF THE INVENTION

I have discovered a climbing aid comprising a rigid support bar having a climbing spike on one end and held within a horizontal slot in a boot. In preferred embodiments, the bar and slot are located under the forward portion of the heel of the wearer and extend entirely through the boot, from one side to the other, and there is a spring clip to retain the bar in the slot and an upward extension of the bar above the spike to protect the boot and wearer. The bar, spike, and extension are formed as an integral piece of metal and the material of the boot is reinforced in the areas surrounding the spike.

DESCRIPTION OF THE PREFERRED EMBODIMENT

We turn now to a description of the preferred embodiment of the invention, after first briefly describing the drawings.

DRAWINGS

STRUCTURE

Figure 1:
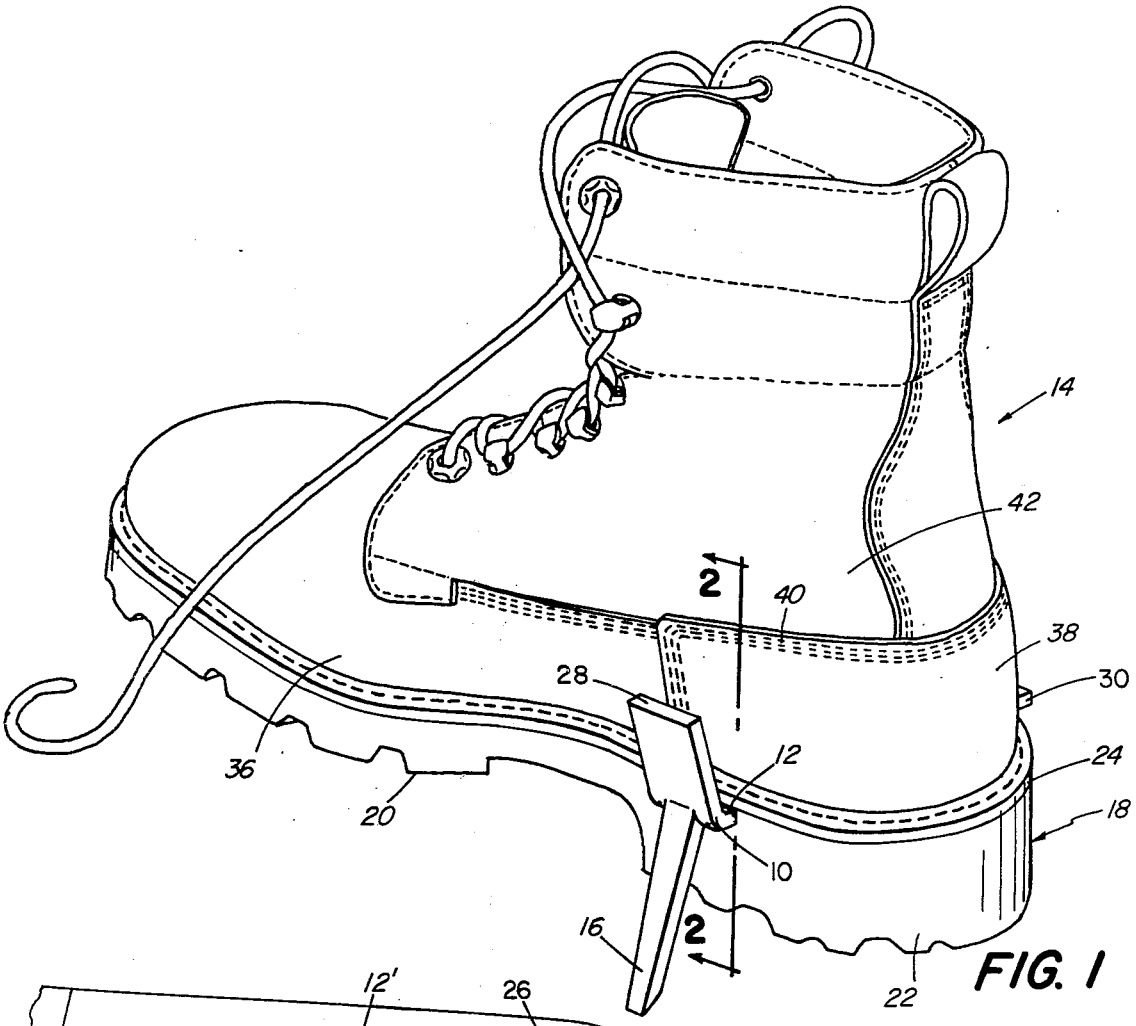
FIG. 1 is a perspective view of the boot with the bar installed.

As shown in FIG. 1, bar 10 is inserted into slot 12 in boot 14 with spike 16 on the inner, or tree side, of the boot.

Figure 2:
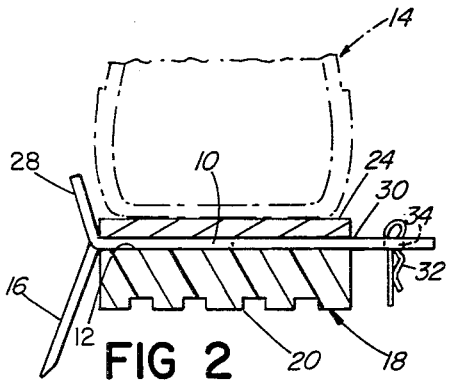
FIG. 2 is a sectional view taken along 2—2 of FIG. 1 with the boot partially in broken lines.
Figure 3:
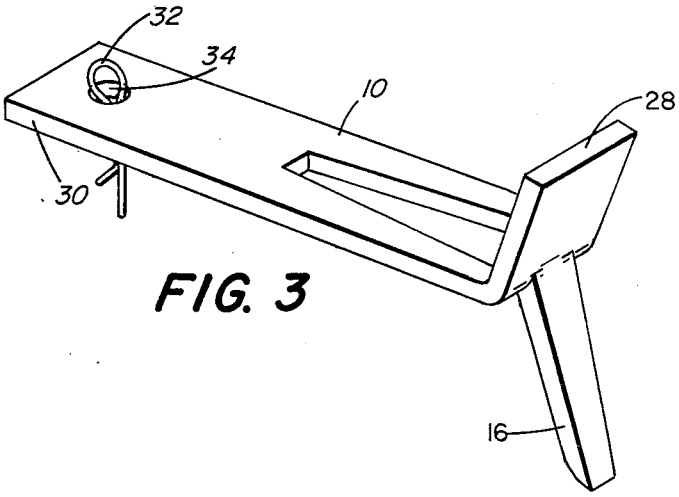
FIG. 3 is a perspective view of the bar of FIG. 1.

Referring to FIGS. 2 and 3, steel bar 10 (1 inch wide by 3/16 inch thick) and slot 12 (1-1/32 inch wide by 7/32 inch high) extend entirely through boot 14, from the inner to the outer side of sole assembly 18, so that the bar can provide support across the full width of the wearer's foot. The width of the bar is greater than its thickness and the width of the slot is greater than its height, to prevent the bar from turning in the slot in use, and clearance between the bar and the slot is such that the bar can be easily inserted into and withdrawn from the slot without permitting excessive motion of the bar when in place.

Referring to FIGS. 1 and 2, sole assembly 18 includes outsole 20 having a heel 22 and a middle sole 24, which are made of conventional materials, e.g., leather, rubber, and man-made materials. The sole assembly is constructed by conventional methods, i.e., cementing, stitching, and molding. Slot 12 is formed by the lower surface of middle sole 24 and a groove in outsole 20, and is located under the forward portion of heel 22 (aligned with the axis of the wearer's leg).

Spike 16 (½ inch wide by 3/16 inch thick and 2 inches long, and tapering to a chisel point) extends downwardly and outwardly from bar 10 at an angle (110°) which is selected to provide the maximum holding force, while allowing spike 16 to be driven into a tree conveniently and easily. The point of spike 16 extends approximately 1¾ inches below bar 10.

Guard extension 28 (1 inch wide by 3/16 inch thick and 1⅛ inches long) extends upwardly from bar 10 generally along the side of boot 14, to protect boot 14, and the wearer, from wear or injury, when driving spike 16 into a tree.

Extension 30 (1 inch wide by 3/16 inch thick) of bar 10 extends 1⅛ inches beyond the outer side of sole assembly 18 and spring clip 32 (a hair-pin type cotter pin) is inserted into hole 34 (¼ inch diameter and centered in extension 30) to prevent bar 10 from sliding out of slot 12.

Referring to FIG. 3, bar 10, spike 16, guard extension 28, and extension 30 are formed from a single piece of steel, thereby providing increased strength and reduced manufacturing costs. A truncated V-shaped cut corresponding to the dimensions of spike 16 is made in a piece of steel having a cross section corresponding to bar 10 and a length equal to the total of the combined lengths of bar 10 and extensions 28 and 30. The sections corresponding to extensions 28 and 30 are at opposite ends of the piece of steel and the cut is located generally in the portion corresponding to extension 28, with the truncated point of the V towards the section corresponding to extension 30 and located 3⅛ inches from the end of the extension 28 section. The extension 28 section is bent upwardly to an angle of approximately 105° to bar 10 to form extension 28, and that section lying within the truncated V-shaped slot is bent downwardly and outwardly from extension 28 to an angle of 110° with respect to bar 10 to form spike 16. The inner face of that portion now forming spike 16 is then cut away to give spike 16 a chisel point, and hole 34 is formed in that portion of the bar forming extension 30.

Referring again to FIG. 1, vamp 36, quarter 38, and stitching 40 of boot 14 are reinforced, with the quarter overlapping the vamp, to protect the wearer from injury and to protect the boot from being scuffed or ripped, when spike 16 is driven into a tree.

Figure 4:
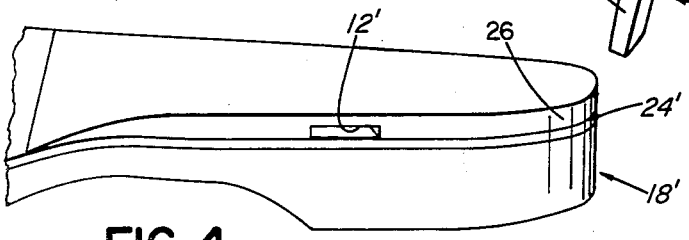
FIG. 4 is a perspective view of a portion of the alternative construction of the boot sole.

FIG. 4 shows an alternative construction of a sole assembly 18' which further includes a heel wedge 26 made in the usual way from conventional materials. Slot 12' is formed by the upper surface of middle sole 24' and a groove in heel wedge 26.

Operation

Boot 14 is constructed to be worn in the same manner as a conventional boot, with the climbing aid providing the ability to scale trees while not interfering with comfort or affecting longevity of the boot. The wearer inserts (on each boot) bar 10 into slot 12, and fastens clip 32 in hole 34 to retain bar 10 in slot 12. To climb a tree, the wearer straddles the tree and drives the climbing spike on each boot into the tree alternately at successively higher points, the location of the slot and bar under the axis of the wearer's leg providing maximum comfort in climbing and maximum force in driving the spike into the tree.

Other embodiments are within the following claims.

I claim:

1. A climbing aid, comprising:

a boot having a sole assembly, said sole assembly including a middle sole, and an outsole having a heel, a slot extending transversely said sole assembly, said slot being defined by the bottom surface of said middle sole and a groove in the top surface of said outsole above said heel, and a rigid support bar adapted to be inserted in said slot and having a climbing spike adjacent one end thereof, said spike extending downwardly from said bar along the inner side of said heel when said bar is inserted in said slot.

2. A climbing aid, comprising:

a boot having a sole assembly, said sole assembly including a heel wedge, a middle sole fastened to said heel wedge, and an outsole having a heel fastened to said middle sole, a slot extending transversely said sole assembly, said slot being defined by the top surface of said middle sole and a groove in the bottom surface of said heel wedge, and a rigid support bar adapted to be inserted in said slot and having a climbing spike adjacent one end thereof, said spike extending downwardly from said bar along the inner side of said heel when said bar is inserted in said slot.

3. The climbing aid of claim 1 or 2 wherein said slot is above the forward portion of said heel and is aligned with the axis of the wearer's leg.

4. The climbing aid of claim 1 or 2 wherein the width of said support bar is greater than its thickness, and the width of said slot is greater than its height, thereby preventing said bar from turning in said slot.

5. The climbing aid of claim 1 or 2 wherein said slot and said bar extend entirely through said boot from the inner to the outer side of said sole assembly, said bar thereby providing support across the full width of the wearer's foot.

6. The climbing aid of claim 1 or 2 wherein the axis of said spike and the axis of said bar form an obtuse angle, said spike thereby extending downwardly and outwardly from said sole assembly.

7. The climbing aid of claim 1 or 2 wherein said spike is at least two inches long.

8. The climbing aid of claim 5 further comprising a retaining means, said retaining means comprising:

a retaining extension of said bar, said retaining extension extending beyond the outer side of said boot, a hole located in said retaining extension, and a retaining clip adapted to fit into said hole.

9. The climbing aid of claim 1 or 2 further comprising an upward extension to said bar, said upward extension extending above said spike and along the inner side of said boot for protecting said boot.

10. The climbing aid of claim 1 or 2 wherein said slot and said bar extend entirely through said boot from the inner to the outer side of said boot, and further comprising:

a retaining extension at one end of said bar, said retaining extension extending beyond said outer side of said boot and having a hole adapted to receive a clip for retaining said bar in said slot, and an upward extension at the other end of said bar, said upward extension extending generally above said spike and along said inner side of said boot.

11. The climbing aid of claim 10 wherein said bar, said retaining extension, said spike, and said upward extension are an integral piece of metal.

12. The climbing aid of claim 8, wherein said retaining clip is a hair pin type cotter pin.

* * * * *